US005706960A

United States Patent [19]

Pitman et al.

[11] Patent Number: 5,706,960

[45] Date of Patent: Jan. 13, 1998

[54] EXTENDED PERIMETER X-SHAPED OUTRIGGER ASSEMBLY FOR CRANES

[75] Inventors: Raymond F. Pitman, Leawood; Richard J. Stallbaumer, Overland Park, both of Kans.

[73] Assignee: Pioneer Engineering, Grandview, Mo.

[21] Appl. No.: 388,385

[22] Filed: Feb. 14, 1995

[51] Int. Cl.[6] ..... B66C 23/80

[52] U.S. Cl. ..... 212/304; 212/305; 280/764.1

[58] Field of Search ..... 212/302, 303, 212/304, 305; 414/543; 280/764.1, 765.1, 766.7

[56] References Cited

U.S. PATENT DOCUMENTS

| | | | |
|---|---|---|---|
| 3,261,478 | 7/1966 | Sonerud | 212/305 |
| 3,262,582 | 7/1966 | Pitman et al. . | |
| 3,985,036 | 10/1976 | Decker et al. | 212/304 |
| 3,987,563 | 10/1976 | Baur | 212/304 |
| 4,084,777 | 4/1978 | Lambert | 212/304 |

*Primary Examiner*—Thoams J. Brahan

*Attorney, Agent, or Firm*—Hovey, Williams, Timmons & Collins

[57] ABSTRACT

A mobile crane having frame structure supporting a boom and turret unit between the front and rear wheel axles of the crane is provided with four outrigger arms which are extensible to present an extended perimeter X-shaped pattern. The outrigger arms are each swingably attached to the crane for swinging movement from retracted positions adjacent the turret of the crane, to extended X-pattern defining dispositions where the ground engaging pads of the two forward-most extended outrigger arms are generally aligned with the axis of the front axle of the crane, and the ground engaging pads of the two rearmost outrigger arms are generally aligned with the axis of the rear axle of the crane. Each of the outrigger arms is constructed such that the outer pad supporting ends move through an essentially upright path of travel as they approach, move toward and then move below ground level at the wheels of a crane.

16 Claims, 5 Drawing Sheets

EXTENDED PERIMETER X-SHAPED OUTRIGGER ASSEMBLY FOR CRANES

BACKGROUND OF THE INVENTION

1. Field of the Invention

This invention relates generally to mobile, wheel supported cranes having structure supporting a boom and turret unit, and particularly to an outrigger assembly for such cranes which is extensible to present a substantially X-shaped pattern.

In a preferred embodiment, the outrigger assembly has four extensible arms which are swingable from upright retracted positions adjacent the crane turret, to extended locations where the ground engaging pads of the two forwardly and outwardly extending outrigger arms are generally aligned with the axis of the front axle of the crane while the ground engaging pads of the two rearwardly and outwardly extending outrigger arms are generally aligned with the axis of the rear axle of the crane.

2. Description of the Prior Art

Truck mounted cranes provided with a rotatable turret supporting an extensible boom are generally provided with outrigger structure for stabilizing the truck, and particularly when the boom is extended and rotated about an axis extending through the boom turret. Two extensible outriggers are usually provided on opposite sides of the frame structure of the truck adjacent the turret.

One exemplary type of outrigger that has been widely adopted is shown in U.S. Pat. No. 3,262,582. The "A-frame" outrigger of the '582 patent consists of a pair of extensible outrigger arms pivotally connected at respective upper ends thereof to opposite sides of the crane structure adjacent the turret. Each outrigger arm includes an inner member swingably mounted on the truck, and an outer extensible member telescopically joined to a respective inner member. A hydraulic piston and cylinder assembly within each arm and connected to the truck and the outer shiftable member respectively is operable to extend and retract a corresponding arm. Links between the inner outrigger member of each arm and the frame of the truck cause each outrigger arm to extend and simultaneously swing outwardly from the truck as an associated piston and cylinder assembly is actuated.

Thus, when each outrigger arm is extended, that arm swings outwardly from the truck about the point of pivotal connection of the arm to the truck, and the outer member extends downwardly until the pad thereon engages the ground.

This outrigger construction is generally satisfactory for boom operations to one side or the other of the truck. However, when it is desirable to lift loads with the boom over the front of the truck, or at the rear of the truck, front and rear accessory outriggers are desirable to stabilize the mobile crane. These accessory outriggers usually are in the form of vertically movable bumper outriggers which may be lowered from their retracted positions to ground-engaging disposition and then pinned in place.

Another disadvantage of the "A-frame" outrigger as depicted in the '582 patent is that fact that unless the surface engaged by the pad of the outrigger arm is at the exact point where the linkage between the extensible arm and the support frame is exactly horizontal, the pad scuffs the road surface because the linkage continues to move through an arc until the outrigger pad is in firm engagement with the ground surface.

SUMMARY OF THE INVENTION

The mobile crane outrigger assembly of this invention has four extensible arms which are mounted on the frame structure of the crane adjacent the boom supporting turret. Each of the arms is swingable from a retracted, generally upright position, to an outwardly extending location where a pad on the outer end engages the ground. The four arms are swingably mounted in disposition such that when they are all extended, the arms cooperatively define a generally X-shaped pattern.

Truck mounted cranes of the type which are most advantageously provided with the extended perimeter X-shaped outrigger structure thereof have front and rear wheel axles with the boom turret being mounted behind the truck cab and thereby between the axles. Each outrigger arm is made up of an outer extensible member telescoped over an inner member that is pivotally connected to the truck frame structure. A piston and cylinder assembly within each arm is connected between the truck frame structure and the outer member so that retraction and extension of the piston causes concomitant retraction and extension of the outer arm member.

A pair of links join the frame structure to the outer member of each arm so that as the piston of each piston and cylinder assembly is actuated, a respective arm is caused to swing from its normally upright stowed position adjacent the boom turret, to an extended position projecting outwardly from a corresponding side of the truck, until a pad on the outer end of the arm is in firm engagement with the ground. The geometry of the piston and cylinder assembly, the lengths of the telescoped members, the position of the pivot point for the inner member of each arm, the location of the pivot point for the connecting linkage, the length of the linkage and its point of connection to the outer extensible member of a respective arm, is such that during extension of an arm and thereby swinging of such arm from its retracted position toward its extended location, the outermost extremity of that arm moves in a substantially vertical plane throughout the latter part of its path of travel.

In particular, the described geometry is such that during extension of each arm, when that arm reaches a point where it is substantially horizontal, movement of the arm thereafter is along a path causing the outer extremity of such arm with the ground engaging pad thereon to move toward to the ground along a generally vertical line. Among other things, this geometry accomplishes two advantageous purposes.

First, the outrigger arm may be extended through a displacement whereby the outer extensible member carrying the ground engaging pad thereon can go below the level of the ground at which the truck is supported by its wheels, thus providing crane stability under uneven terrain conditions. Second, the outrigger pad does not scuff the pavement or other surface even when it is extended through a displacement to bring the pad into engagement with the ground at a point below that at which the truck is supported, or for that matter, when the pad contact is with a surface that is above the truck wheel ground support level.

Mounting of the four outrigger arms on the truck frame structure in disposition such that they project outwardly at angles with respect to one another, presenting an X-pattern when fully extended, allows the crane operator to use the boom at any extended position around the perimeter of the truck without regard to stability consideration. The crane is stable regardless of the position of the boom around the entire perimeter of the truck.

The crane stability provided by the X-shaped outrigger pattern is enhanced by virtue of the fact that the outrigger arms are located to engage the ground in their extended positions with the pads of the two forward-most, outwardly projecting outrigger arms in substantial alignment with the axis of the front axle of the truck, while the pads of the two rearmost, outwardly projecting outrigger arms are in substantial alignment with the axis of the rear axle of the truck. This X-defining outrigger footprint assures that outrigger pad alignment with respective axes of the truck axles is retained even if there are irregularities in the terrain on opposite sides of the truck.

Another feature of the invention is the fact that mounting of the outriggers in stowed, upright positions closely adjacent the turret, permits the manually manipulable controls for each of the actuatable piston and cylinder assemblies to be located at the turret in a location where the operator can visually observe each of the outrigger arms as it is extended and until the pad thereon is in firm engagement with the ground.

DETAIL DESCRIPTION OF THE PREFERRED EMBODIMENTS

Figure 1:
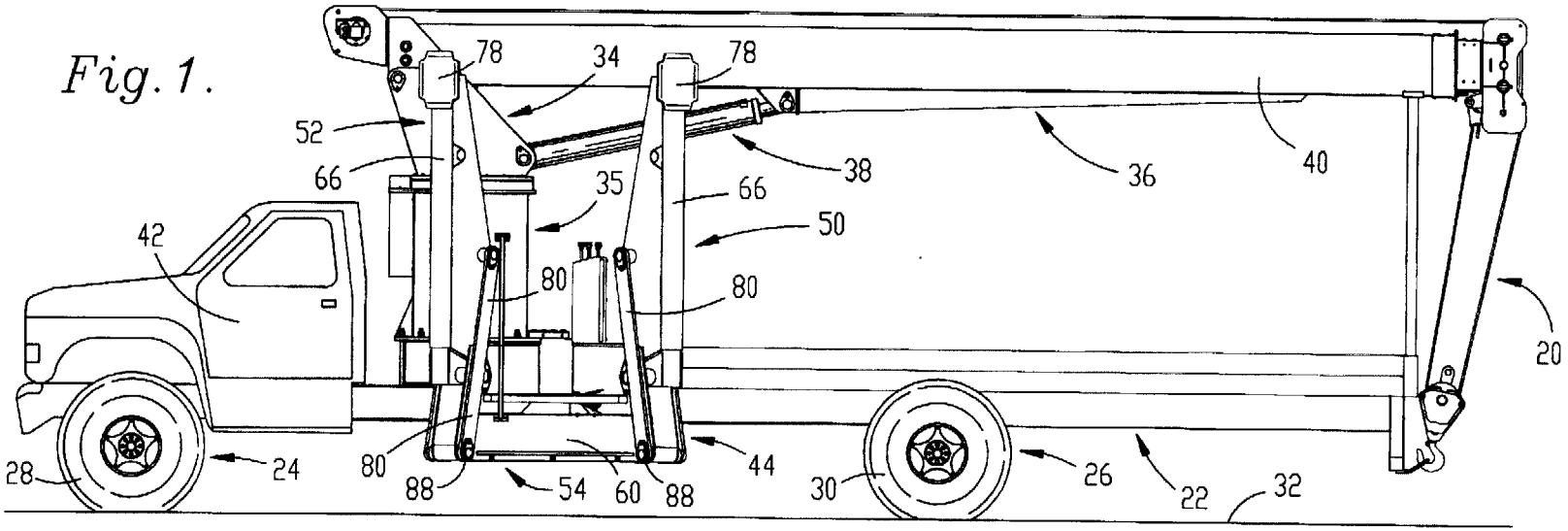
FIG. 1 is a side elevational view of a truck mounted crane which incorporates outrigger structure of the present invention in showing the four outrigger arms in their normal upright stowed positions adjacent the turret of the crane, and also showing the boom in a stowed, rearwardly extended position.

A truck mounted crane broadly designated by the numeral 20 is illustrated in FIGS. 1–6, and includes fore-and-aft frame structure 22 which carries front wheel axle assembly 24 and rear wheel axle assembly 26. Assembly 24 mounts front wheels 28 while assembly 26 mounts rear wheels 30, all of which are supported by the ground 32.

Crane 20 includes a turret 34 carried by main frame 35. Turret 34 supports a rotatable, extensible boom unit 36 that may be of conventional construction. Hydraulically actuated mechanism (not shown) within the turret is operable to rotate boom unit 36 through an arc of at least 360° C., while piston and cylinder assembly 38 serves to raise and lower the base boom 40 relative to the turret. One or more extensible booms are telescopically received within base boom 40, and extensible under the control of hydraulically actuated mechanism within the boom structure. It can be seen from FIGS. 1–4 that the turret 34 is desirably mounted on frame structure 22 between front and rear axle assemblies 24 and 26, and desirably immediately behind truck cab 42.

The outrigger structure 44 of this invention includes four outrigger arm assemblies 46, 48, 50 and 52 respectively mounted on the frame structure 22 of the truck adjacent turret 34. An underslung weldment 54 is secured to frame structure 22 beneath turret 34 for mounting respective outrigger arm assemblies 46–52 on the truck 20. As is evident from FIGS. 1–6, weldment 54 includes a pair of spaced, parallel, angularly disposed plate components 56 and 58 for each of the outrigger arm assemblies 46–52. The plate components 56 on each side of the truck are joined by an intermediate box connector 60 forming a part of the weldment 54.

Figures 7, 8, 9:
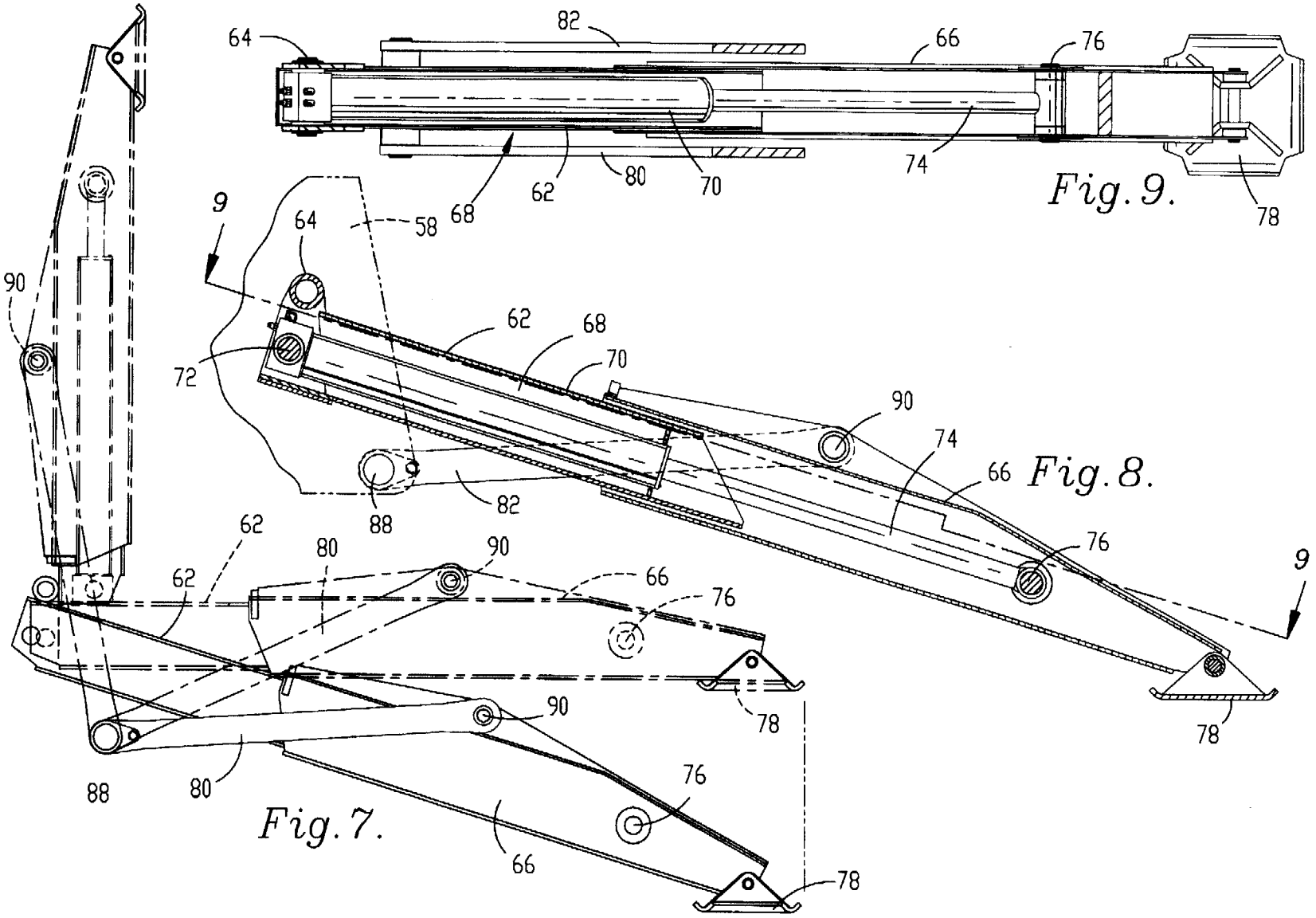
FIG. 7 is an enlarged fragmentary elevational view of one of the outrigger arms with the normal upright stowed position thereof being shown in dashed lines, an intermediate horizontal position thereof also being illustrated in dashed lines, and the normal extended ground engaging position being shown in full lines.
FIG. 8 is an enlarged fragmentary vertical cross-sectional view of the outrigger arm as depicted in FIG. 7 and taken on the line 8—8 of FIG. 4 and looking in the direction of the arrows.
FIG. 9 is a cross-sectional view taken substantially on the line 9—9 of FIG. 8 and looking in the direction of the arrows.

Viewing FIGS. 7, 8 and 9, each of the outrigger arm assemblies 46–52 includes an inner tubular member 62 pivotally mounted between respective plate components 56 and 58 for swinging movement about the axis of pivot sleeve 64. An outer tubular member 66 is telescoped over member 62 for sliding movement relative thereto. A piston and cylinder assembly 68 within the telescopically interconnected members 62 and 66 includes a hydraulic cylinder 70 attached to the innermost end of member 68 through the medium of a connector pin 72. Piston rod 74 of assembly 68 is joined to the outer member 66 through the provision of a connector pin 76. A ground engaging pad 78 is pivotally mounted on the outer end of member 66.

Two links 80 and 82 join the outer member 66 of each arm assembly 46–52, to respective plate components 56 and 58. As is most apparent from FIGS. 1–7, the links 80 and 82 are pivotally connected to plate components 56 and 58 below the pivot axes of respective sleeves 64, and are pivotally joined to corresponding members 66 intermediate the ends of the latter.

The control means for hydraulic piston and cylinder assembles 68 for each of the outrigger arm assemblies 46–52 preferably comprises a control panel 84 having a manually manipulable control lever 86 for a respective arm assembly. It is to be seen from FIGS. 1–3 that a workman standing on the box connector 60 on a respective side of the truck 20 may manipulate a desired control lever 86 while visually observing extension and retraction of each of the outrigger arm assemblies 46 and 48.

Figure 4:
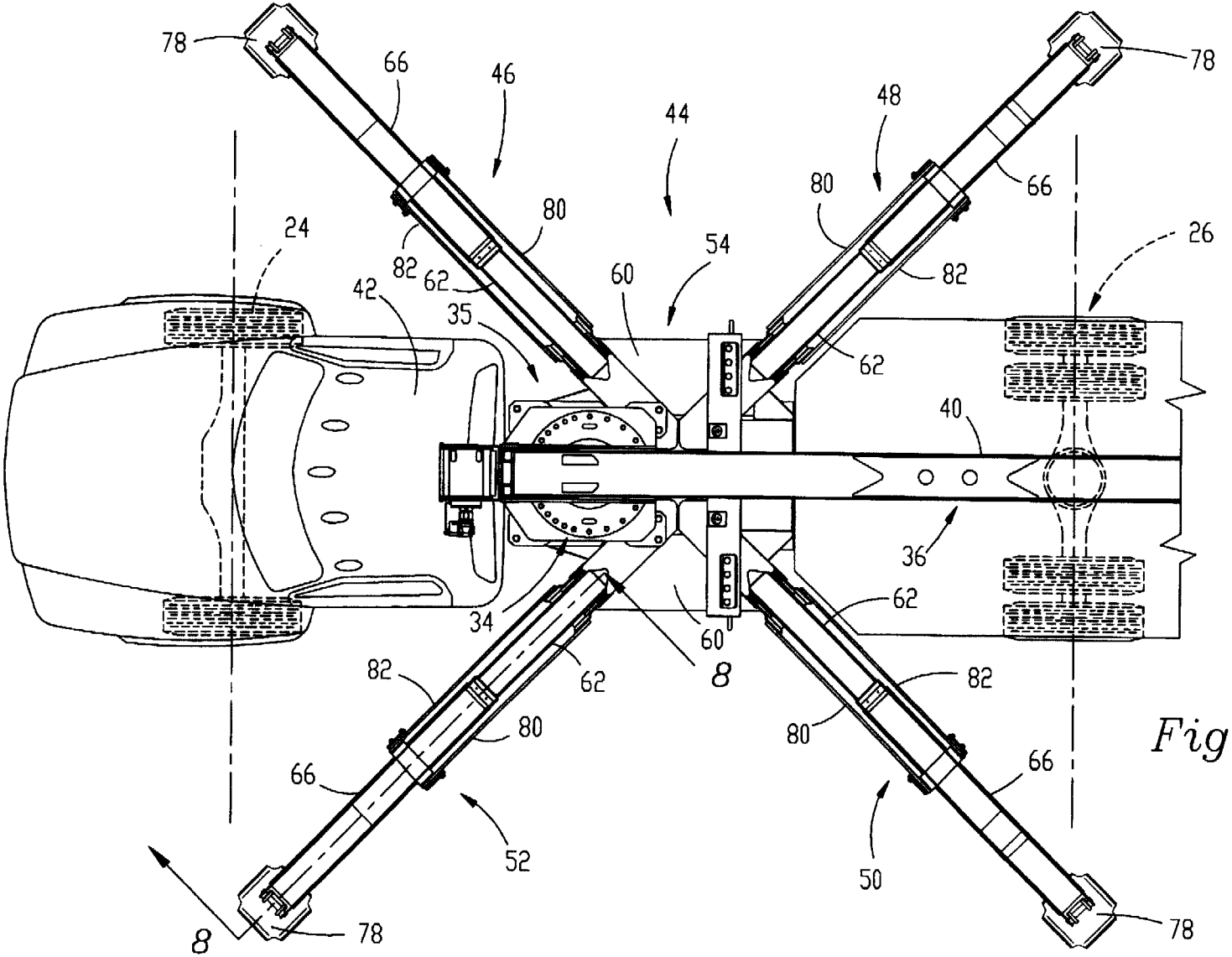
FIG. 4 is a fragmentary plan view of the truck mounted crane as shown in FIG. 2 and illustrating the X-defining pattern of the outrigger arms in their fully extended positions, with the outrigger pads generally aligned with respective front and rear axles of the truck.
Figure 5:
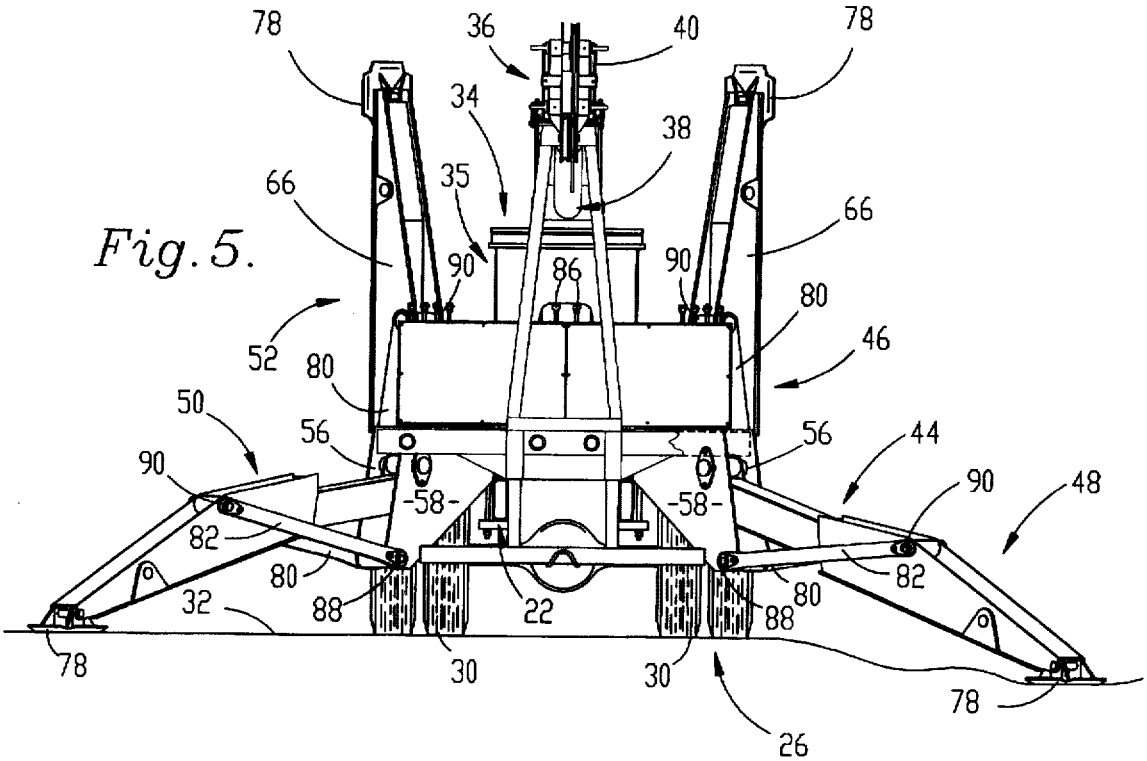
FIG. 5 is a rear elevational view of the truck mounted crane as shown in FIG. 2.

In operation, when the operator of crane 20 manipulates a respective control lever 86 to extend one of the outrigger arm assemblies 46–52, pressurized hydraulic fluid from the hydraulic system of the crane is supplied to the piston end of the cylinder 68 of a selected outrigger arm assembly 46–52, thereby causing the piston rod 74 to move outwardly and thereby extend the outer tubular member 66 of the arm assembly. During such extension of member 66 with respect to inner member 62, associated links 80 and 82 cause that arm assembly to pivot from its upright stowed position adjacent turret 34 as depicted in FIGS. 1, 3, 5 and 6 toward the extended position thereof as shown in FIGS. 2, 4 and 5.

Outward movement of the rod 74 of the selected outrigger arm assembly and consequent swinging of the tubular member 62 and 66 during extension of the outrigger arm, continues until the pad 78 on the outermost end of member 66 engages the ground.

Extension of outrigger arm assemblies 46 and 48 through arcs sufficient to bring the pads 78 into firm engagement with the ground even though one or more points around the perimeter of the truck may be actually below the level 32 at which the truck is situated, is attributable to a number of factors. These include the interrelated lengths of members 62 and 66 and the lengths of links 80 and 82, and the geometry presented by the point of pivotal connection 64 of each member 62 to plate components 56 and 58 with respect to the point of pivotal connection 88 of corresponding links 80 and 82 to plates 56 and 58, and the point of pivotal connection 90 of each pair of links 80 and 82 to a respective outer tubular member 66.

The pad 78 on each arm assembly 48 may move below ground level 32 where the truck is located in the event the terrain on opposite sides of the vehicle is below level 32. The fact that the outrigger assemblies 46 and 48 may be actuated to an extent that pads 78 actually move below the ground support elevation for the truck permits the crane operator to more precisely level the truck using a conventional bubble within the truck cab.

The elevation of pivot connections 88 for links 80 and 82 of each outrigger arm assemblies 46 and 48 should be as low as feasible. The lower these pivot points are, the less force that must be applied to respective piston and hydraulic cylinders 68 of each outrigger arm assemblies 46 and 48. However, the pivot connections 88 should not be significantly lower, if at all, than the lowermost structural part of truck mounted crane 20 such as the truck axles, the differential, the exhaust system for the truck, or suspension components. Preferably, the pivot connections 88 are at least slightly above the lowermost structural components of the truck as is evident from FIGS. 5 and 6 of the drawings.

It is also important to note as best shown in FIG. 7, that the lengths of the components described above, and the geometry of the pivotal connections therefore, is such that after the selected outrigger arm assembly has been swung from its upright stowed position to essential horizontal disposition, a pad 78 on the outer end of the arm 66 moves downwardly in essentially a vertical plane. This vertical movement at the end of the path of travel of a selected outrigger arm assembly is important from a standpoint of preventing scuffing of the surface upon engagement thereof by a pad 78, even if the surface engaged by the pad is not at the same elevation as surface 32 supporting truck 20.

As is most apparent from FIGS. 2, 5, 7 and 8, the points of pivotal connection 88 and 90 of links 80 and 82 to plates 56 and 58 and associated tubular member 66 of arm assemblies 46 and 48 are located in relative disposition such that during extension of the arm assemblies 46 and 48, the pivotal connections 90 of links 80 and 82 do not go over center. Thus, the pivotal connection points 90 of respective links 80 and 82 never go beyond an imaginary line drawn between connector pins 72 and 76 of each piston and hydraulic assembly 68.

Furthermore, as a result of the relative positions of pivot connections 88 and 90 for links 80 and 82 of each arm assembly 46 and 48, and the disposition of those pivot connections with respect to the point of pivotal mounting of arm assemblies 46 and 48 on respective plate components 56 and 58, the arcuate movement of pivot connections 90 during extension of arm assemblies 46 and 48 is primarily in a vertical direction with very little movement in a horizontal direction. This means that the motion of pads 78 is essentially in a vertical direction as indicated in FIG. 7 during the latter part of the path of travel of arm assemblies 46 and 48 during extension thereof, and there is no appreciable horizontal movement of pads 78. As previously pointed out, the pads 78 therefore do not scuff underlying pavement and the like when the outriggers 46 and 48 are extended to the stabilizing positions thereof shown in FIGS. 2, 4 and 5.

When the motion of each of the pivot connections 90 for a respective pair of links 80 and 82 is analyzed on the basis of a cosine curve, the position of each pivot connection 90 in the upright stowed position of a respective outrigger arm assembly 46 or 48 will be at 0°. During initial swinging movement of a corresponding outrigger arm assembly 46 and 48 from the stowed position thereof toward the extended location of the same, pivot connections 90 move horizontally to a greater extent than in a vertical direction. However, when a respective outrigger arm 46 and 48 reaches a generally horizontal position as depicted by the dashed lines of FIG. 7 and therefore the pivot connections 90 for corresponding links 80 and 82 are at the 90° position of the cosine curve, it is to be perceived that movement of the pivot connection 90 as it approaches the 90° cosine curve position, and as it leaves that position, is essentially vertical with very little horizontal component. As a consequence, as each outrigger arm 46 and 48 is extended, the movement of the outer end of a respective tubular member 66 and the pad 78 mounted thereon is in a generally vertical direction as depicted in FIG. 7 during the final swinging movement of the outrigger arm. This prevents scuffing of pavement or the like by the pads 78, even during the time the vehicle is being lifted by the outriggers to transfer part of the crane weight onto respective outrigger pads 78 in firm engagement with the ground.

Similarly, during retraction of the outriggers, the pivot connections 90 for respective links 80 and 82 follow the same cosine curve so that as the outer extremities of the outrigger arms are raised from the ground, there is no tendency to scuff pavement as the weight of the vehicle is again transferred back onto its suspension system.

The smaller the angle of links 80 and 82 of each outrigger arm assembly 48 and 50 with respect to horizontal when a respective outrigger arm assembly is in horizontal orientation during extension of a respective arm assembly 46 and 48, but without pivot connections 90 going over center, the less the horizontal movement of pads 78 as the outrigger arm assemblies reach their full extended positions with the pads 78 engaging the ground. Thus, there is less tendency for pads 78 to move back toward the truck mounted crane 20 as the outrigger pads 78 are brought into engagement with the ground and piston and cylinders assemblies 68 further extended to transfer at least a part of the load of the crane onto the outriggers. The angle of links 80 and 82 with respect to horizontal when respective outrigger arm assemblies 46 and 48 are oriented horizontally during extension thereof, should not exceed about 30° and desirably is at an angle of no more than about 5° to 10°.

The vertical movement of pads 98 during the latter portion of their paths of travel has another advantage in that the pads are essentially in static frictional engagement with the ground as the loads on the crane vary during lifting of objects with boom unit 36. The static coefficient of frictional engagement of pads 78 with the ground results in a significantly higher frictional value than would be the case if the pads 78 were in dynamic frictional engagement with the ground thereby making it possible to using a smaller piston and cylinder assembly 68 for each outrigger arm assembly 46 and 48, than would otherwise be the case.

The disposition of links 80 and 82 of each outrigger arm assembly 46 and 48, and the strategic location of pivot connections 88 and 90 with respect to one another and relative to associate pivot sleeve 64 results in the links 80 and 82 being in compression as the outrigger arms 46 and 48 unfold, but once the pads 78 of respective outrigger arms engage the ground, the load on links 80 and 82 then shifts into tension. Again, this result obtains by virtue of the fact that pivot connections 90 do not go over center during full extension of respective outrigger arm assemblies 46 and 48.

Figure 3:
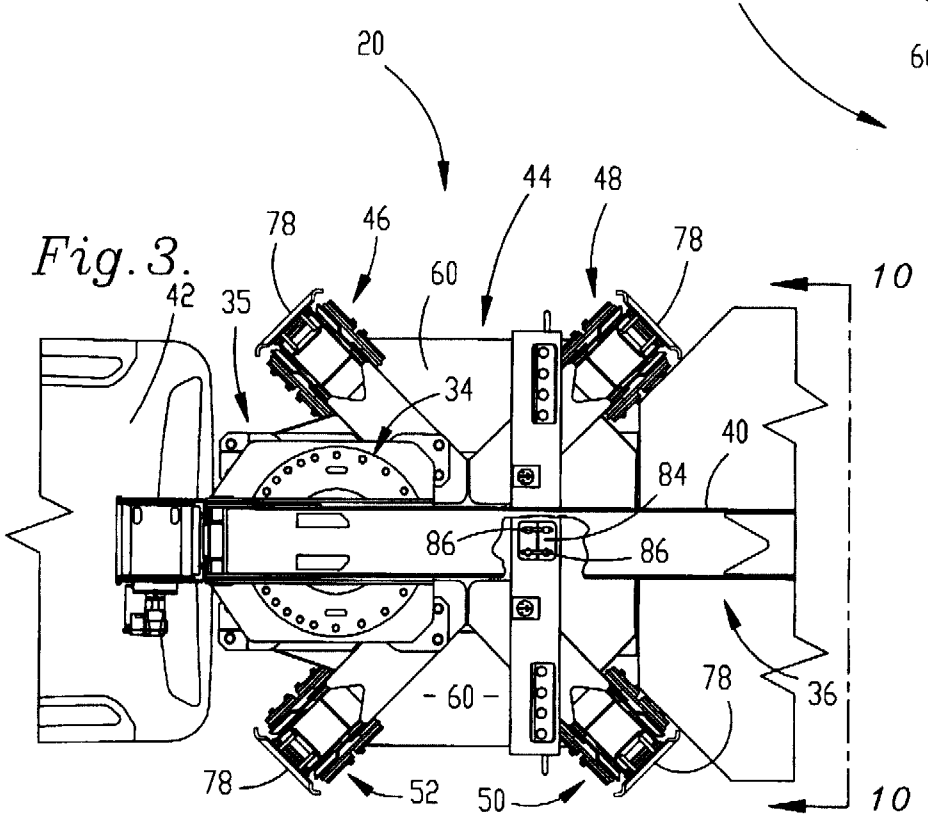
FIG. 3 is a fragmentary plan view of the truck mounted crane as shown in FIG. 1 and illustrating the stowed positions of the outriggers adjacent the boom turret.

Again viewing FIG. 3, it is to be noted that an operator standing on the upper surface of either of the box connectors 60 while manipulating control levers 86 of control panel 84 may observe each of the outrigger arm assemblies 46 during extension thereof throughout the entire swinging motion of a selected outrigger assembly. In this manner, the operator can readily determine whether or not the outrigger has firmly engaged the ground and has contacted the surface in a stabilizing manner.

The lengths of members 62 and 66 are also such that upon full extension of all of the outrigger arm assemblies 46 and 42 as shown in FIG. 4, the pads 78 thereon are generally aligned with the axis of a respective axle assembly 24 or 26 of truck 20. Thus, the four outrigger arm assemblies 46–52 when fully extended define a substantially X-shaped pattern where the angle between each adjacent pair of extended arm assemblies is approximately 45°.

By virtue of the X-shaped configuration of the outrigger structure 44 when fully extended, optimum stabilization of the crane is obtained regardless of the operating position of boom 36 around the perimeter of the truck mounted crane. The boom unit 36 may be used to lift loads around the entire truck 20, including over the front of the truck, by virtue of the equalized stabilizing effect of the X-shaped outrigger pattern. This is especially important when working over the front end of the truck 20 because the springs for front wheel axle assembly 24 are not as stiff as the springs associated with rear wheel axle assembly 26.

Figure 2:
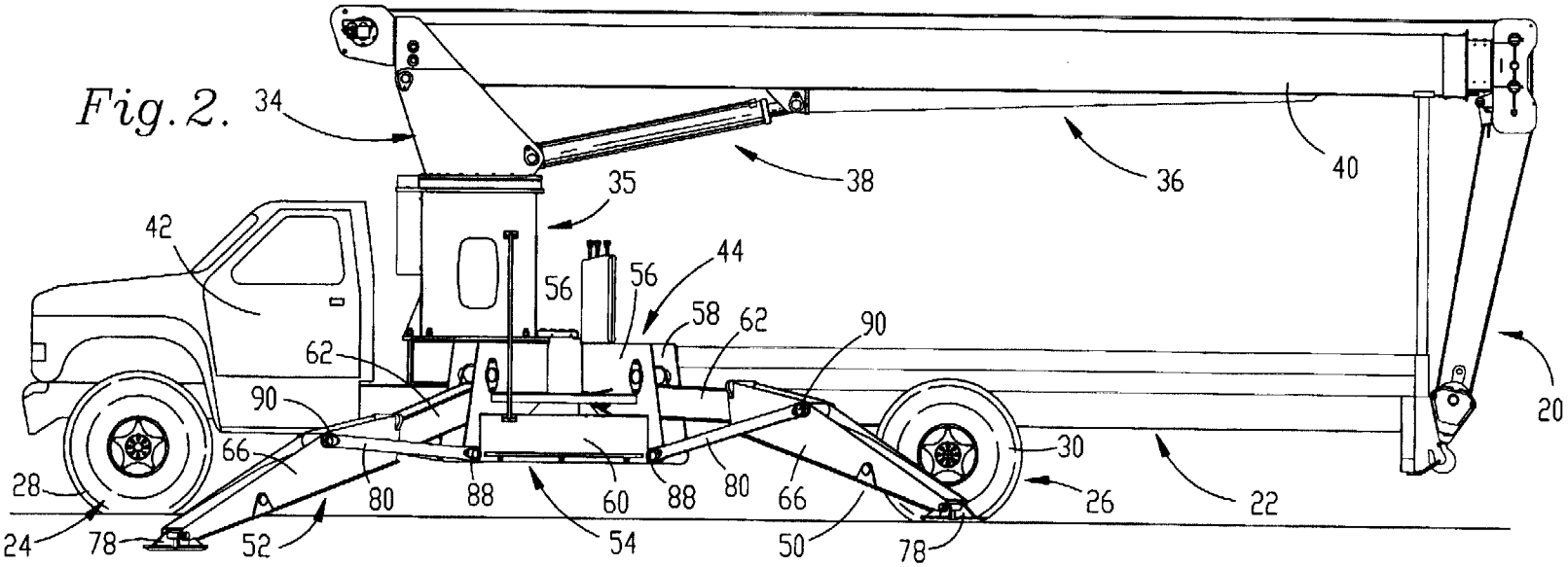
FIG. 2 is a side elevational view similar to FIG. 1 and showing the outrigger arms in their normal extended positions, with the forwardmost outrigger arm on the viewers side of the truck being lower than the rear-most outrigger on that side of the truck, to illustrate the way in which each outrigger is moveable through a displacement to bring the ground engaging pad thereon below the level of the surface on which the truck is directly supported.
Figure 10:
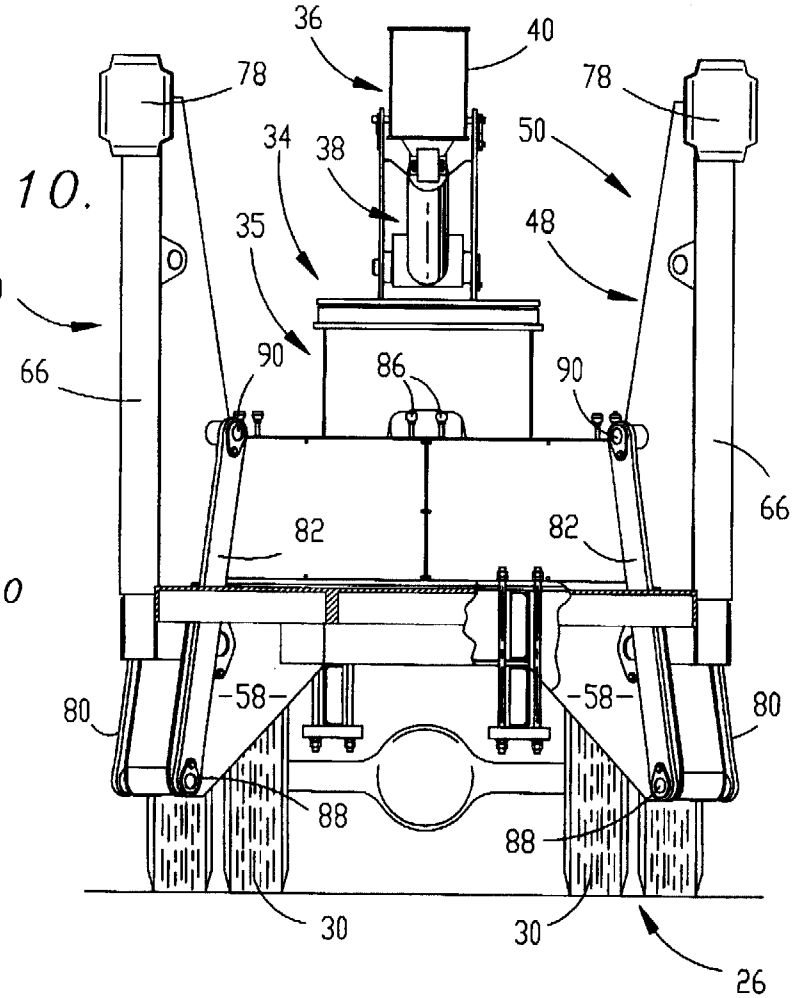
FIG. 10 is an enlarged cross-sectional view taken substantially along the line 10—10 of FIG. 3 and looking in the direction of the arrows.
Figure 6:
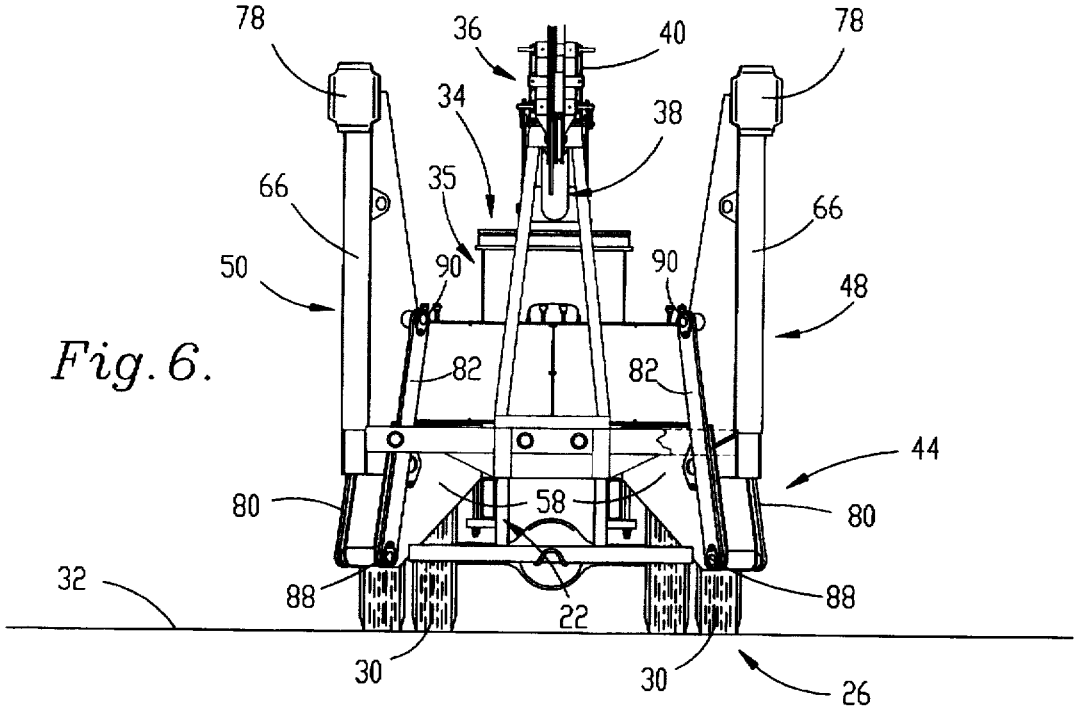
FIG. 6 is a rear elevational view of the truck mounted crane as shown in FIG. 1.

Retraction of corresponding arm assemblies 46–52 to the stowed positions thereof as shown in FIGS. 1, 3 and 6 is accomplished by the simple expedient of reversing the movement of corresponding rods 74 by manual manipulation of an associated control lever 86. Again, the operator has an unobstructed view of the outrigger arms during retraction so as to avoid any engagement of the outrigger arm with a workman or an obstruction not present when the outriggers where extended.

Location of the center of extended outriggers 46–52 in proximal relationship to the axis of rotation of boom unit 36, and positioning of the turret 34 immediately behind cab 42 allows use of outriggers which are not inordinately long when extended, while still being in alignment with a respective wheel axis of the vehicle.

An alternate embodiment of each of the outriggers assemblies 46 and 48 involves a substitution of a ball screw unit for each piston and cylinder assembly 68. The screw of such unit would be rotated by a hydraulic motor, while the ball, threaded over the screw, would be joined to outer member 66 of each of the outriggers assemblies. Operation of the hydraulic motor connected to each screw to effect rotation in a selected direction, functions to cause the outer member 66 of each outrigger assembly to be extended or retracted in response to screw rotation. Each of the hydraulic motor for rotating respective ball screws would be under the control of a respective lever 86.

We claim:

1. In a mobile crane having opposed sides and provided with structure supporting a boom and turret unit, an extended perimeter X-shaped outrigger assembly comprising:

four extensible outrigger arms each having an inner member and an outer member which is movable relative to a respective inner member to permit the reach of a corresponding outrigger arm to be extended;

means for pivotally attaching said inner members of the outrigger arms to the crane for swinging movement of respective outrigger arms about corresponding inner member pivot points on the crane with two of the arms being on one side of the crane and the other two arms being on the opposite side of the crane, said attachment means for the inner arm members permitting each of the arms to swing about respective pivot points on the crane for downward and outward swinging movement of the outrigger arms from retracted positions adjacent respective sides of the crane to extended locations projecting outwardly from corresponding sides of the crane, the outer ends of each pair of arms on a respective side of the crane moving away from one another as the arms on corresponding sides of the crane are swung from the retracted positions thereof toward the extended locations of the same, the four arms being located on the crane in disposition such that they cooperatively define a generally X-shaped pattern when all of the arms have been swung toward their extended locations; and actuating means connected between the crane and each of the arms for effecting swinging movement of respective arms to and from the retracted and extended locations thereof while extending and retracting the outer members relative to respective inner members of corresponding outrigger arms, said actuating means including power means coupled to the outer member of each outrigger arm to shift a respective outer member with respect to the associated inner member of a corresponding outrigger arm to effect extension and retraction thereof, said actuating means for each outrigger arm further including elongated linkage means pivotally joined at one end thereof to the outer member of each outrigger arm to effect swinging movement of a corresponding outrigger arm in response to operation of the associated power means, said linkage means each being of a length and pivotally connected to the crane and to the outer member of a corresponding outrigger arm respectively in disposition causing the outermost extremity of each outer member of a respective outrigger arm to move in a generally upright path of travel during swinging movement of a respective outrigger arm through the last portion of its arc of travel toward the extended location thereof.

2. A mobile crane as set forth in claim 1 wherein said attachment means for pivotally attaching the outrigger arms to respective sides of the crane is in disposition and said actuating means for swinging corresponding arms cooperate to effect swinging of each arm into a retracted, substantially upright position adjacent a corresponding side of the crane with the outer end of each arm generally directly above said inner end thereof.

3. A mobile crane as set forth in claim 1 wherein said members of each outrigger arm are disposed in telescopic relationship.

4. A mobile crane as set forth in claim 3 wherein said power means includes a hydraulically operated piston and cylinder assembly within the telescopic inner and outer members of each arm, each of said assemblies being supported by the crane and connected to an outer member of each arm respectively for shifting a corresponding outer member with respect to the inner member thereof.

5. A mobile crane as set forth in claim 1 wherein is provided first pivot means joining a respective linkage means to a corresponding outer member of each arm, and second pivot means connecting a respective linkage means to a corresponding side of the crane, each of said first pivot means being connected to a respective outer member of a corresponding outrigger arm at a location such that each of the first pivot means is at an elevation above the second pivot means for a respective outrigger arm when each outrigger arm is fully extended thereby preventing the linkage means for each outrigger arm from going over center during swinging of a respective outrigger arm to its extended location.

6. A mobile crane as set forth in claim 5 wherein said first and second pivot means for each said linkage means are positioned such that a respective linkage means is in compression during extension of a corresponding outrigger arm, and is in tension when the outer end of a respective outrigger arm engages the ground.

7. A mobile crane as set forth in claim 5 wherein said first pivot means for each of said linkage means is connected thereto in disposition such that the first pivot means for each of said linkage means is at an elevation below the point of pivotal connection of a respective inner member of a corresponding outrigger arm to a respective side of the crane.

8. A mobile crane as set forth in claim 1 wherein said linkage means for each of the arms is joined to a respective side of the crane below the point of pivotal attachment of a corresponding inner member of each arm to a corresponding side of the crane.

9. In a mobile crane having front and rear wheel axles, frame structure supporting the axles, and a boom and turret unit carried by the frame structure between the front and rear axles, an extended perimeter X-shaped outrigger assembly comprising:

four extensible outrigger arms each having an inner member and an outer member which is movable relative to a respective inner member to permit the reach of a corresponding outrigger arm to be extended;

means for pivotably attaching said inner members of the outrigger arms to the frame structure of the crane for swinging movement about corresponding pivot points on the frame structure with two of the arms being on one side of the crane and the other two arms being on the opposite side of the crane thereby presenting a pair of forwardmost arms and a pair of rearmost arms, said attachment means for the inner arm members permitting each of the arms to swing about respective pivot points on the frame structure for swinging movement from retracted positions adjacent respective sides of the crane to extended locations projecting outwardly from corresponding sides of the crane, the outer ends of each pair of arms on a respective side of the crane moving away from one another as the arms on corresponding sides of the crane are swung from the retracted positions thereof toward the extended locations of the same, the four arms being located on the crane in disposition such that they cooperatively define a generally X-shaped pattern when all of the arms have been swung toward their extended locations with the outermost extremities of said forwardmost arms being in general alignment with the axis of the front axle and the outermost extremities of said rearmost arms being in general alignment with the rear axle; and actuating means connected between the frame structure and each of the outrigger arms for effecting swinging movement of respective arms to and from the retracted and extended locations thereof while extending and retracting the outer members relative to respective inner members of the outrigger arms, said actuating means including linkage means connected to said outer members of each of the outrigger arms and to the frame structure, said linkage means being of a length and in disposition to cause the outermost extremity of each outrigger arm to move in a generally upright path of travel during extension and swinging movement of a respective outrigger arm through the last portion of its arc of travel toward the extended location thereof.

10. A mobile crane as set forth in claim 9 wherein the arms are mounted on the frame structure in disposition such that upon extension thereof by said actuating means, the outermost extremity of each arm is movable into a location below ground level at a respective wheel of the crane.

11. A mobile crane as set forth in claim 9 wherein said outrigger arms are swingably attached to the frame structure adjacent said turret thereon, said means for pivotably attaching the outrigger arms to respective sides of the frame structure in said means for swinging corresponding arms being operable to swing each arm into a retracted substantially upright position adjacent the turret.

12. A mobile crane as set forth in claim 9 wherein the angles between each adjacent pairs of arms when all four arms are in the extended locations thereof, are approximately equal.

13. A mobile crane as set forth in claim 9 wherein is provided a ground engaging pad pivotally mounted on the outermost extremity of each arm.

14. A mobile crane as set forth in claim 9 wherein each of said members of each outrigger arm are disposed in telescopic relationship, said actuating means for each outrigger arm including a hydraulically operated piston and cylinder assembly within the telescopic inner and outer members of each arm, each of said assemblies being joined to the frame structure of the crane and said outer member of each arm respectively for shifting a corresponding outer member with respect to the inner member thereof.

15. A mobile crane as set forth in claim 14 wherein is provided manually manipulable control means for each of the piston and cylinder assemblies, said control means being mounted adjacent the turret permitting an operator to extend and retract each of the outrigger arms while stationed adjacent the turret, said control means being located in disposition such that the operator may observe the outer extremities of all four outrigger arms as they are swung from the retracted positions thereof to the extended positions of the same.

16. A mobile crane as set forth in claim 9 wherein said outrigger arms are pivotally attached to the crane adjacent said turret thereon.

* * * * *